US006169476B1

(12) United States Patent
Flanagan

(10) Patent No.: US 6,169,476 B1
(45) **Date of Patent: *Jan. 2, 2001**

(54) EARLY WARNING SYSTEM FOR NATURAL AND MANMADE DISASTERS

(76) Inventor: John Patrick Flanagan, 160 Sequoia Ave., Carlsbad, CA (US) 92008

( * ) Notice: Under 35 U.S.C. 154(b), the term of this patent shall be extended for 0 days.

This patent is subject to a terminal disclaimer.

(21) Appl. No.: 09/272,767

(22) Filed: Mar. 19, 1999

Related U.S. Application Data

(63) Continuation-in-part of application No. 08/802,448, filed on Feb. 18, 1997.

(51) Int. Cl.[7] ..... G08B 9/00
(52) U.S. Cl. ..... 340/286.02; 340/690; 364/421
(58) Field of Search ..... 340/286.02, 690, 340/540; 364/421; 324/323, 344

(56) References Cited

U.S. PATENT DOCUMENTS

| | | | | |
|---|---|---|---|---|
| 4,155,042 | | 5/1979 | Permut et al. . | |
| 4,408,196 | * | 10/1983 | Freeman | 340/690 |
| 4,633,515 | | 12/1986 | Liber et al. . | |
| 4,649,524 | * | 3/1987 | Vance | 340/690 |
| 4,841,278 | | 6/1989 | Flig et al. . | |
| 4,841,287 | * | 6/1989 | Flig et al. | 340/690 |
| 4,956,875 | | 9/1990 | Bernard et al. . | |
| 5,214,757 | | 5/1993 | Mawney et al. . | |
| 5,436,610 | * | 7/1995 | Ballesty et al. | 340/286.02 |
| 5,490,062 | * | 2/1996 | Leach et al. | 364/421 |
| 5,838,237 | | 11/1998 | Revell et al. . | |
| 5,910,763 | * | 6/1999 | Flanagan | 340/286.02 |

* cited by examiner

*Primary Examiner*—Daniel J. Wu
*Assistant Examiner*—John Tweel, Jr.

(57) ABSTRACT

An early warning system for all natural and manmade disasters to collect and analyze data in real time as disasters occur, and when necessary, transmit early warnings to cause mitigation responses to lessen the disaster impact on lives and property. The system detects disasters in real time and determines the type, magnitude, speed, direction, and the expected geographic area to be impacted. Early warnings are transmitted to a wide variety of microprocessor receiver/controllers embedded in commonly used consumer and commercial devices to create a universal standard for receiving warnings and allow both human and automated responses during disasters to greatly increase the effectiveness of the warnings to users. The system determines precise real time position and location coordinates as well as other types of current geographic information data for all mobile and stationary devices capable of receiving early warning signals. This allows the system to transmit directed early warnings to only those specific receivers or group of receivers that are in danger from a disaster as determined by the current location and geographic information for each receiver. The system minimizes false or unnecessary warnings and greatly increases a receiver's confidence in the necessity to take effective mitigation actions during natural or manmade disasters. The system also provides emergency response instructions In a timelier manner to emergency response personnel in all areas prior to a disaster Impact to allow a higher quality emergency mitigation response.

16 Claims, 6 Drawing Sheets

SYSTEM SCALE VIEW OF CELL WARNINGS

BLOCK DIAGRAM OF DISASTER WARNING NETWORK

BLOCK DIAGRAM OF NETWORK USER IDENTIFICATION DATABASE

SYSTEM SCALE VIEW OF CELL WARNINGS FIG. 4

SYSTEM SCALE VIEW OF SELECTED USER WARNINGS

EARLY WARNING SYSTEM FLOWCHART FIG. 6
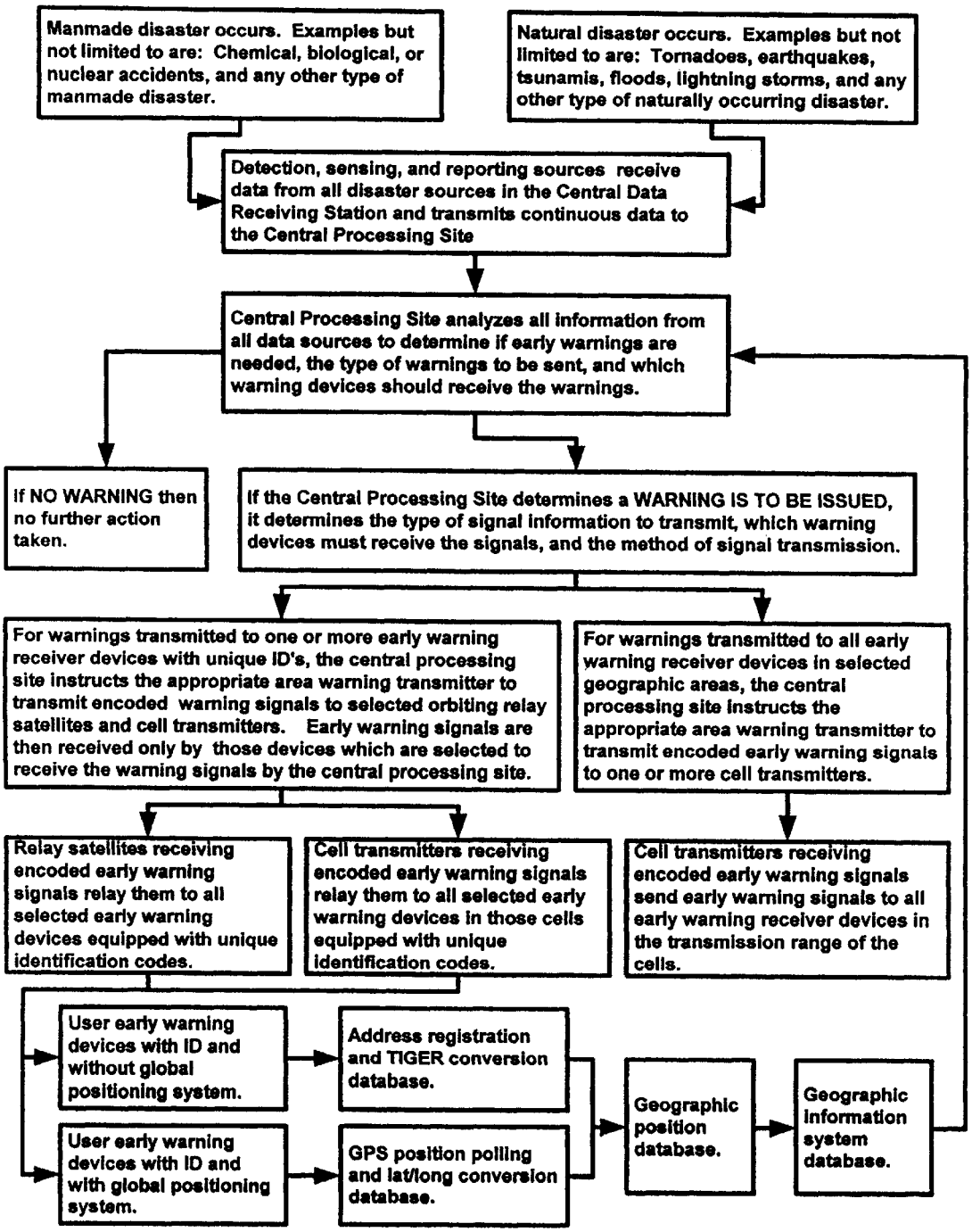

EARLY WARNING SYSTEM FOR NATURAL AND MANMADE DISASTERS

ORIGIN OF INVENTION

The invention described herein is a continuation-in-part of pending application Ser. No. 08/802,448 filed Feb. 18, 1997 and presents additional utility of existing functions described in that application, as well as presenting new matter that is relevant to and comes from that application.

REFERENCES CITED

U.S. Pat. No. 4,155,042 Issued May 15, 1997 Permut et al.

U.S. Pat. No. 4,633,515 Issued Dec. 30, 1986 Uber et al.

U.S. Pat. No. 4,956,875 Issued Sep. 11, 1990 Bernard et al.

U.S. Pat. No. 5,214,757 Issued May 25, 1993 Mauney et al.

U.S. Pat. No. 5,838,237 Issued Nov. 17, 1998 Revell et al.

FIELD OF THE INVENTION

This invention relates to a system that detects, analyzes, and provides early warnings of all types of natural and manmade disasters that could impact any size area or specific individuals in an area. Early warnings are transmitted to any selected receiver or any selected group of receivers in any size of geographic area. The transmitted early warnings provide time for system users to seek shelter or take other action to avoid injury or death. The transmitted early warnings also initiate automated responses by a wide variety of commonly used electronic devices to reduce property damages as well as injuries and lives lost during the occurrence of natural and manmade disasters.

DESCRIPTION OF THE BACKGROUND ART

Almost every community experiences some of the many forms of natural disasters such as earthquakes, floods, tornadoes, lightning storms, or tsunamis. In modern times communities are also increasingly faced with manmade disasters from chemical, biological, or nuclear accidents. These emergency situations may affect all or a portion of the persons and property in these communities. For most citizens advanced early warnings of these natural and manmade catastrophic threats are either non-existent or are received by very small percentages of the population when disasters threaten.

Principal conclusions from the literature indicate that the few early warning systems in place today suffer many deficiencies. They warn areas much larger than is necessary. They provide warnings only for a limited number of threats and are not universal in nature. They do not provide timely warnings with a maximum lead time for proper response. They typically rely on warning sirens that must be in hearing range or on broadcast warnings that rely on an active receiver with human attention and human responses.

For these reasons the studies have shown that a very small percentage of any threatened population from a disaster actually receives an early warning from any source, and when received, is not timely or is ignored as a probable false alarm for the location of the receiver.

For early warning systems of natural and manmade disasters to be effective they should meet the following requirements:

- Only those in actual danger of risk must receive warnings, for when warnings are routinely issued for areas in which only a small percentage of the population is in danger, the warnings lose effectiveness and are often ignored;
- The warning system must be able to provide warnings for all types of natural and manmade disasters that might reasonably be expected to impact a specific area;
- The warnings must be timely in nature and must provide a maximum amount of warning time to allow for timely responses;
- The warnings must give appropriate and detailed information describing the nature and type of disaster event that is imminent;
- The warnings must be received and utilized by a wide variety of devices in order to reach people no matter what activity they are involved in;
- The warning signals must be able to activate warning devices that have been left in an inactive mode; and
- The warning signals must be received and utilized by a wide variety of devices that will initiate automatic responses that do not require human action or intervention, and thereby function to save lives, and reduce injuries and property damages.

Most people today first hear of a disaster event from a commercial broadcast to their television or radio. These broadcasts typically require the receiver to be turned on, and to have the attention of a person to receive the warning. Most of the receivers do not even function in the event of a power failure and so could not provide a warning. Further, the warnings are very general in nature and typically provide only general unnecessarily widespread geographic area warnings the size of one or more counties. They typically warn only of weather related disasters and were originally designed to work in combination with outdoor sirens as part of the civil defense network for nuclear war threats. The warning sirens have very high maintenance requirements, often cannot be heard indoors, and are too area non-specific and general in nature. These systems do not and cannot fulfill the requirements for an effective early warning system.

One step up in effectiveness are the various tone alert pagers and specialized weather radios that are on the market. These systems suffer from the same type of generalized warnings and low user confidence that is seen with all current systems. Additionally, these are single use devices that must be programmed for their location and this limits the number of people willing to make an investment. Further none of these systems is designed to provide warning signals to a wide variety of pre-programmed commercial devices that can perform automatic responses in the event of a disaster event to limit the loss of lives, injuries, and property damages.

U.S. Pat. No. 4,155,042 to Permut et al., speaks to the need to warn specific receivers of a wide variety and type through the use of specifically encoded transmissions with the first transmission alerting the devices to receive the second warning signal with the effect being able to warn a specific or group of specific receivers. Permut assumed the knowledge of receiver location and does not speak to the need in a large population of receivers to know the specific location of each receiver in order to know which receivers to alert. Permut did not teach to the need to know other types of geographically related information to properly analyze and determine which receivers to warn so that only those receivers needing to be warned would receive warnings.

Permut further assumed site-specific receivers and did not address the issue of an early warning receiver's location of the need to warn receivers based on location and other geographic information. Finally, Permut did not teach to determining the characteristics of a disaster prior to warning and therefore could not address the issue of appropriate warnings to appropriate areas in a timely manner.

U.S. Pat. No. 4,633,515 to Uber et al., addresses the issue of activating receivers left in an inactive mode, and provides for a tone alert detector to search multiple frequencies for a specific disaster broadcast message that is preceded by a specified type of tone prior to its broadcast insuring that the receiver will find and play the broadcast warning. Uber does not teach how disasters are detected and analyzed, or teach the ability to locate receiver position and how to transmit warnings to only selected locations.

U.S. Pat. No. 4,956,875 to Bernard et al., offers an encoding means in a upgraded fashion to Uber and suffers the same lack of additional means to a truly effective disaster early warning network.

U.S. Pat. No. 5,214,757 to Mauney et al., teaches a method to create digital maps to locate specific locations with a variety of related geographic attributes. This allows the type of GIS information needed to make proper analysis of geographic information of any specific user. Mauney did not teach or anticipate early disaster warnings or methods to warn.

U.S. Pat. No. 5,838,237 to Revell et al., addresses personal alarm devices which record specific location of mobile or stationary devices in order to transmit real time location information to police and law enforcement agencies in the event of kidnapping or other types of personal danger for individuals. Revell did not teach or anticipate a means toward an effective disaster early warning system as noted above.

A truly effective early warning system should be able to determine exactly which early warning receivers are in actual danger from a natural or manmade disaster, and then should be able to transmit an early warning to only those selected early warning receivers. This system should be able to analyze all available information about disasters in real time as well as all available information about the geographic position and other real time geographic information about all system early warning receivers.

The warnings must provide a maximum amount of warning time with specific information about the type and nature of the disaster. Both fixed and mobile receivers in either an active or inactive mode must receive the warnings. The warning signals must be able to be received by a wide variety of devices that can provide audible warnings for human response as well as preprogrammed automated responses.

Finally, a truly effective early warning system should be able to continuously track the position and geographic information for a wide range of emergency response personnel. The system should be able to warn exact appropriate emergency response personnel as to the type and magnitude of disaster that is imminent, the expected path of damage, and other types of current and continuously updated geographic information that will lead to a more effective emergency response during disasters.

The limitations shown in the prior art systems toward the requirements for an effective early warning system for natural and manmade disasters will become more apparent in comparison with the present invention.

OBJECTS AND ADVANTAGES OF THE INVENTION

Accordingly, several objects and advantages of the present invention are:

A. To provide an improved means for early warnings to be transmitted to an entire population in any given geographic area determined to be in danger from any type of natural or manmade disasters to allow for a wider variety of mitigation responses that will reduce damages to lives and property.

B. To provide a means for early warnings of these disasters to be transmitted to all early warning receivers in any selected geographic sized area to effectively prevent false or unnecessary warnings being sent to areas that are not in danger to increase the value and effectiveness of received warnings.

C. To provide a means for early warnings of these disasters to be transmitted to any selected warning receiver or to any selected group of receivers in any geographic area to eliminate false or unnecessary warnings.

D. To provide a means to determine and analyze the location, magnitude, and movement patterns of natural and manmade disasters to allow a determination of exactly which warning devices and which areas are to receive warnings, and thereby minimize false and unnecessary warnings and increase user confidence in the value of the warning information.

E. To provide a means to identify the precise geographic position of early warning devices to allow early warning signals to only those specific stationary warning receivers needing to be warned.

F. To provide a means to identify and continuously upgrade the precise geographic position of early warning devices to allow early warning signals to only those specific mobile early warning receivers needing to be warned.

G. To provide a means in the event of a natural or manmade disaster to activate audible alarms and automated ancillary devices that are normally in an inactive mode so that responses can be made at all times with or without human response or presence.

H. To provide a means for activation of automated responses for any selected electronic device or selected group of electronic devices embedded with preprogrammed automatic controls, which include but are not limited to elevators, gas and fuel line switches, computer systems, traffic and transportation control systems, municipal electrical and emergency systems, and lighting and audible warning systems, to reduce the impact of disasters on people and property I. To provide a means to continually upgrade early warnings with information about location, intensity, direction, and speed, to selected individual receivers or selected groups of receivers so as to maximize the usefulness of the warning signals appropriate to each user.

J. To provide a means for each selected early warning receiver to be identified by a specific location that can be correlated to many other types of geographically appropriate real time information such as elevation, current and prevailing wind patterns, nearby stream levels, population densities, and other types of information to insure that warnings go only to appropriate selected receivers and do not cause widespread alarm or panic.

K. To provide a means for each early warning receiver to be identified by a specific location that can be correlated to many other types of GIS information so that warnings can be sent only to selected receivers in low lying areas for a flood threat, users downwind of a chemical or biological hazard threat, or users along the coast in low lying areas during a tsunami.

L. To provide a means to transmit early warnings of natural or manmade disasters to specific receivers or specific groups of receivers in remote or isolated geographic locations in order to allow for warnings to areas that ordinarily would not receive reliable early warnings such as those living on islands or remote coasts that have poor communications but can still benefit from early warnings with high informational value.

M. To provide a means to notify appropriate emergency response officials in advance of a disaster which specific receivers or specific groups of receivers will be impacted by disasters to allow an appropriate response by those officials to reduce damage to property or injury and loss of lives, and allow for a more highly coordinated rescue or relief response in the shortest possible time.

N. To provide a means to select and to notify appropriate emergency response personnel in advance of a disaster based on the location and other geographic information factors of those individuals and areas that are about to be impacted by disasters to allow a more appropriate response by those emergency personnel to reduce damage to property or injury and loss of lives.

O. To provide a means to select and to notify appropriate emergency response personnel in advance of a disaster based on the current geographic location and other geographic information factors of all available emergency response personnel to allow a more appropriate response by those emergency personnel to reduce damage to property or injury and loss of lives.

Further objects and advantages of my invention will become apparent from a consideration of the drawings and ensuing description.

BRIEF DESCRIPTION OF DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 6 is an early warning system flow chart illustrating the exemplary embodiments of the present invention.

LIST OF REFERENCE NUMBERS

Figure 1:
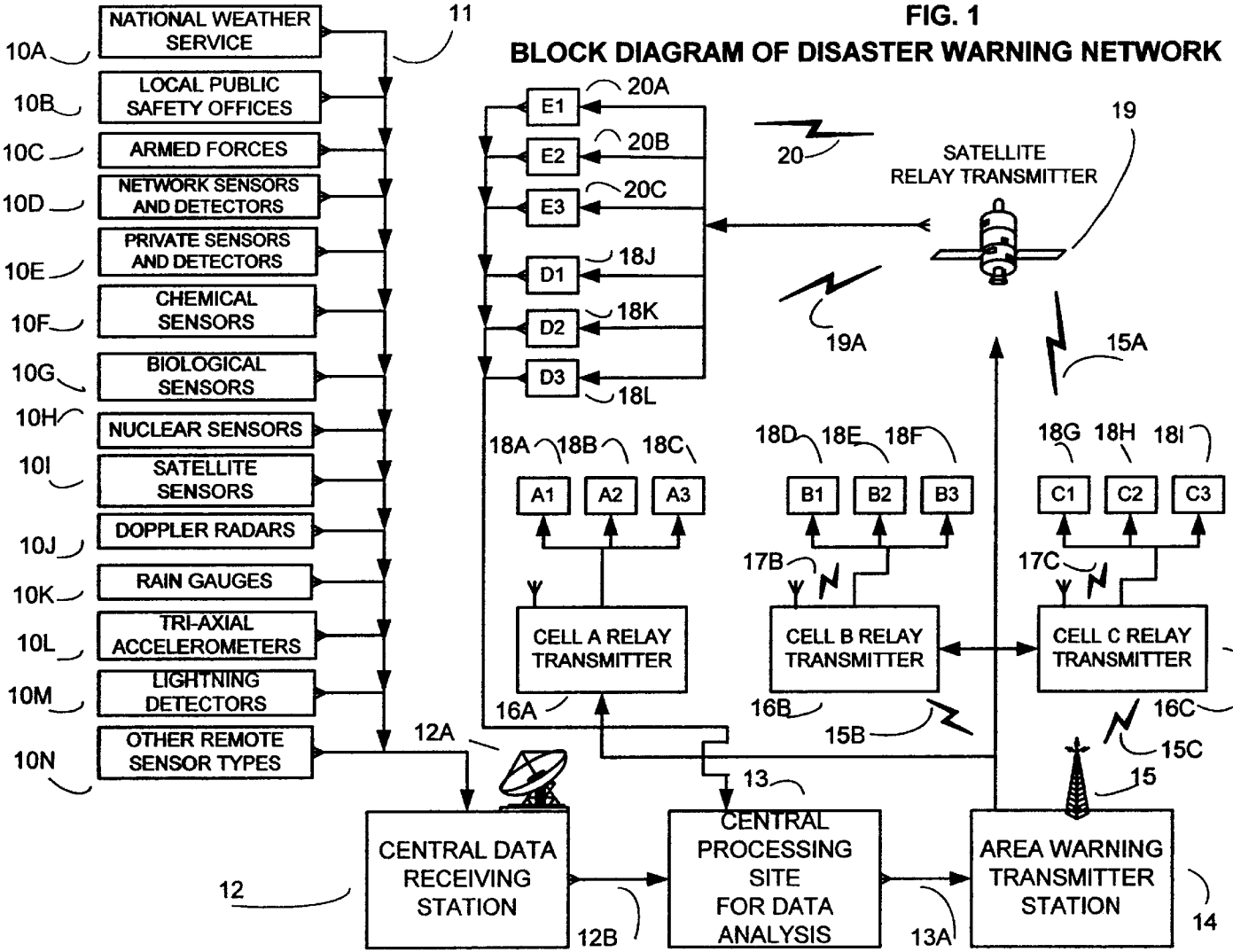
FIG. 1 is a block diagram illustrating an exemplary disaster warning network according to the principles and preferred embodiments of the present invention.

| | |
|---|---|
| 10A | Remote sensing, detection, and reporting source. National weather service. |
| 10B | Remote sensing, detection, and reporting source. Local public safety offices. |
| 10C | Remote sensing, detection, and reporting source. Armed Services. |
| 10D | Remote sensing, detection, and reporting source. Network sensors and detectors. |
| 10E | Remote sensing, detection, and reporting source. Private sensor and detectors. |
| 10F | Remote sensing, detection, and reporting source. Chemical sensors. |
| 10G | Remote sensing, detection, and reporting source. Biological sensors. |
| 10H | Remote sensing, detection, and reporting source. Nuclear sensors. |
| 10I | Remote sensing, detection, and reporting source. Satellite sensors. |
| 10J | Remote sensing, detection, and reporting source. Doppler radar. |
| 10K | Remote sensing, detection, and reporting source. Rain gauges. |
| 10L | Remote sensing, detection, and reporting source. Tri-axial accelerometers. |
| 10M | Remote sensing, detection, and reporting source. Lightning detectors. |
| 10N | Remote sensing, detection, and reporting source. Other remote sensor types. |
| 11 | Data transmissions from distributed remote sensing, detection, and reporting sources. |
| 12 | Central Data Receiving Station. |
| 12A | Central Data Receiving Station data receiver. |
| 12B | Central data receiving station high speed data transmitter. |
| 13 | Central processing site for data analysis. |
| 13A | Central processing site high speed data transmitter. |
| 14 | Area warning transmitter station. |
| 15 | Area warning transmitter station transmitter. |
| 15A | Transmitted encoded early warning signal sent to orbiting relay satellite transmitter from area warning transmitter station. |
| 15B | Transmitted encoded early warning signal sent to Cell B relay transmitter from area warning transmitter station. |
| 15C | Transmitted encoded early warning signal sent to Cell C relay transmitter from area warning transmitter station. |
| 16A | Cell A relay transmitter. |
| 16B | Cell B relay transmitter. |
| 16C | Cell C relay transmitter. |
| 17B | Early warning signals sent by Cell B relay transmitter to all warning receiver devices located in Cell B. |
| 17C | Early warning signals sent by Cell C relay transmitter to all warning receiver devices located in Cell C. |
| 18A | Individual early warning cell receiver device in Cell A. |
| 18B | Individual early warning cell receiver device in Cell A. |
| 18C | Individual early warning cell receiver device in Cell A. |
| 18D | Individual early warning cell receiver device in Cell B. |
| 18E | Individual early warning cell receiver device in Cell B. |
| 18F | Individual early warning cell receiver device in Cell B. |
| 18G | Individual early warning cell receiver device in Cell C. |
| 18H | Individual early warning cell receiver device in Cell C. |
| 181 | Individual early warning cell receiver device in Cell C. |
| 18J | Individual early warning receiver device with a unique identification code. |
| 18K | Individual early warning receiver device with a unique identification code. |
| 18L | Individual early warning receiver device with a unique identification code. |
| 19 | Orbiting satellite relay transmitter. |
| 19A | Encoded early warning signals sent by orbiting satellite relay transmitter to one or all selected early warning receiver devices with a unique identification code as determined and selected by the central processing site. |
| 20 | Encoded early warning instructions sent by orbiting satellite relay transmitter to one or all selected emergency response early warning receiver devices with a unique identification code as determined and selected by the central processing site. |
| 20A | Individual emergency response early warning receiver device with a unique identification code. |
| 20B | Individual emergency response early warning receiver device with |

-continued

LIST OF REFERENCE NUMBERS

| | |
|---|---|
| | a unique identification code. |
| 20C | Individual emergency response early warning receiver device with a unique identification code. |
| 21 | Central processing site main processing system computer and controller. |
| 22 | Input and output data connections with all main processing and database elements of the central processing site. |
| 23 | Neural network parallel processor with event archives and modeling software. |
| 24 | Network user information database. |
| 25 | All system security, monitors, and mechanical maintenance equipment |
| 26 | Central Processing Site power supply. |
| 27 | Central administrative offices for the central processing site. |
| 31 | User early warning devices with unique identification codes and without global positioning system capability. |
| 32 | Physical address registration system. |
| 33 | (TIGER) Topologically Integrated Geographic Encoding and Referencing files. |
| 35 | User early warning devices with unique identification codes and with global positioning system capability. |
| 36 | Global positioning system continuous updated receiver polling. |
| 37 | Latitude and longitude conversion files. |
| 38 | Geographic position database. |
| 39 | Geographic information system database. |

SUMMARY OF INVENTION

The present invention is a system to collect and analyze real time data regarding natural and manmade disasters and when necessary transmit early warnings to any selected warning receiver or to any selected group of receivers in any specific geographic area that might suffer damage to lives or property. These early warnings are transmitted to a wide variety of embedded microprocessors in consumer and commercial devices to provide a ubiquitous means for mitigation responses to lessen the impact of all natural and manmade disasters.

The present invention provides a means of determining precise location coordinates for all mobile and stationary devices capable of receiving early warning signals. The present invention also provides a means of detecting disasters in real time as they occur; and to then determine the exact expected geographic area that will be impacted. The present invention provides a means to transmit directed early warnings to only those specific receivers or group of receivers that are in danger from a disaster. This allows a highly effective warning network that prevents false or unnecessary warnings and utilizes a wide variety of commonly used electronic devices to allow both human and automated responses to greatly increase the effectiveness of the warnings to users.

DETAILED DESCRIPTION OF THE INVENTION

The preferred embodiments involve a combination of features that may be employed in an early warning system for natural and manmade disasters. The following description is illustrative of only one utility of this invention and it will become apparent that the principles of the invention have wider applicability.

FIG. 1 illustrates the main components of a disaster warning network in accordance with the present invention. Seen is a plethora of geographically distributed remote sensing, detection, and reporting sources 10A, 10B, 10C, 10D, 10E, 10F, 10G, 10H, 10I, 10J, 10K, 10L, 10M, and 10N. These data collection sources are both digital and analog inputs, and are from both automated and human derived sources for collecting and transmitting real time data about natural or manmade disasters as they occur. Transmission of this data 11 is received by a data receiving station 12 using the most appropriate form of data receiving device 12A. A transmission means 12B is provided to send collected data to a central processing site 13. A transmission means 13A is provided to send warning alert instructions to an area warning transmitter station 14. This transmitter station has an area warning transmitter station transmitter means 15 to send warning alert signals. Warning alert signal 15A is transmitted to a satellite relay transmitter 19. Warning alert signals 15B and 15C are also sent to cell relay transmitters 16B and 16C. In this view, a cell relay transmitter 16B is shown transmitting a early warning signal 17B to all cell warning receiver devices 18D, 18E, and 18F, within its geographic transmission range. Also shown is a cell relay transmitter 16C transmitting a early warning signal 17C to all cell warning receiver devices 18G, 18H, and 18I, within its geographic transmission range. Encoded early warning signals 19A are shown being transmitted by a satellite relay transmitter 19 to all individual early warning receiver devices with a unique identification code selected by the central processing site 13 to receive warning signals anywhere within its geographic transmission range. Encoded early warning instruction signals 20 are shown being transmitted by a satellite relay transmitter 19 to all individual emergency response early warning receiver devices with a unique identification code selected by the central processing site 13 to receive warning instruction signals anywhere within its geographic transmission range, all in accordance with the present invention.

Figure 2:
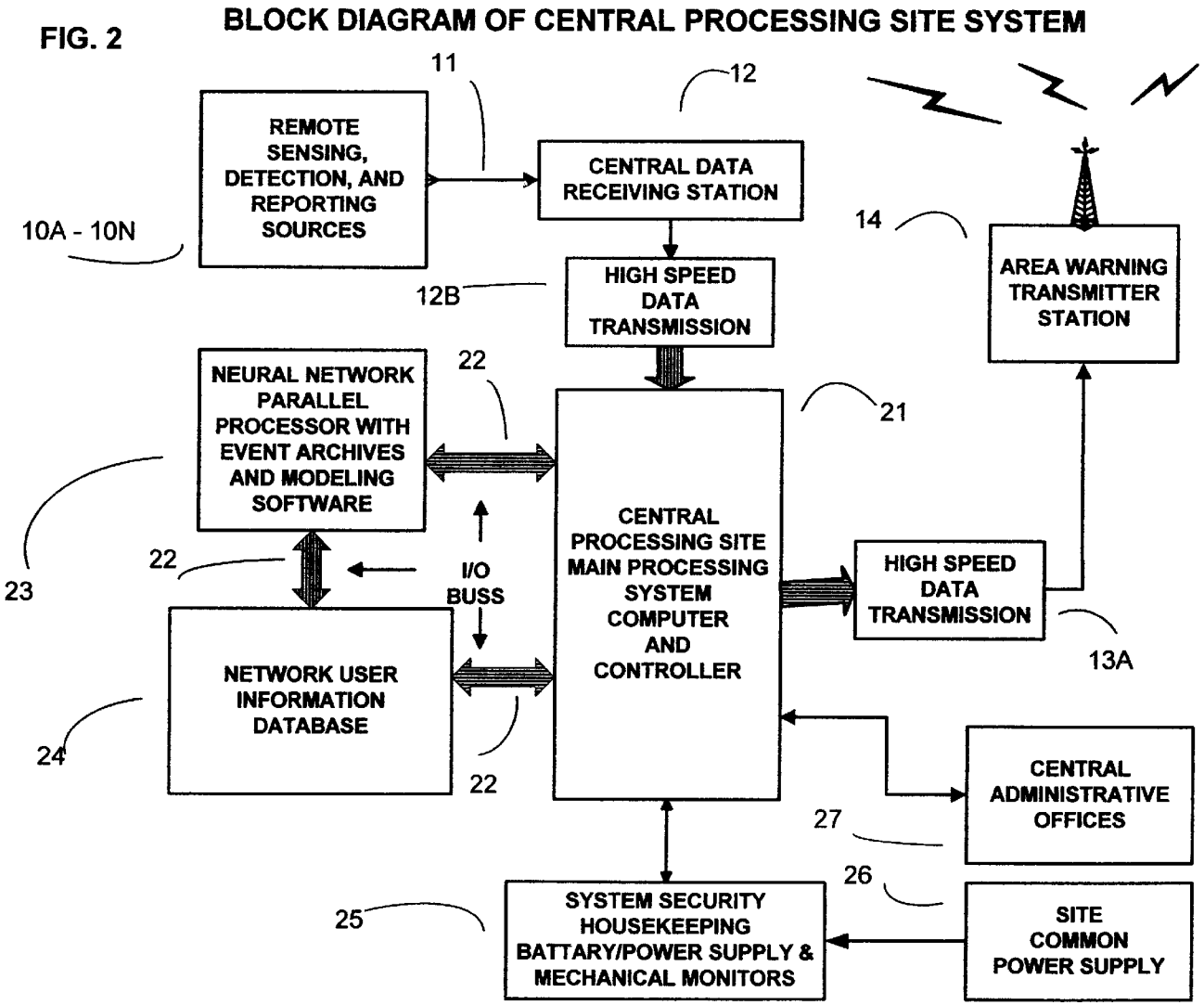
FIG. 2 is a block diagram illustrating the exemplary embodiments of a central processing site according to the principles and preferred embodiments of the present invention.

FIG. 2 illustrates a block diagram of the main components of a central processing site in accordance with the present invention. This view illustrates the plethora of multiple sensor, detector, and reporting sources 10A through 10N. A transmission means 11 is shown for sending received data to the central data receiving station 12. A transmission means 12B is shown for sending high speed data transmissions to a central processing site main processing system computer and controller 21. Input and output data connections 22 are shown as a means for the main processing system computer to continuously exchange data with a neural network parallel processor with event archives and modeling software 23, and with a network user information database 24. A central processing site transmitter using high speed data transmission 13A is shown as a means to transmit the systems computational analysis results and early warning signal instructions to an area warning transmitter station 14. This view shows a means for system security, monitors, and mechanical maintenance equipment 25. Also shown are a means for a central processing site power supply 26, and for on-site central administrative offices 27 for all attending administrative personnel in accordance with the present invention.

Figure 3:
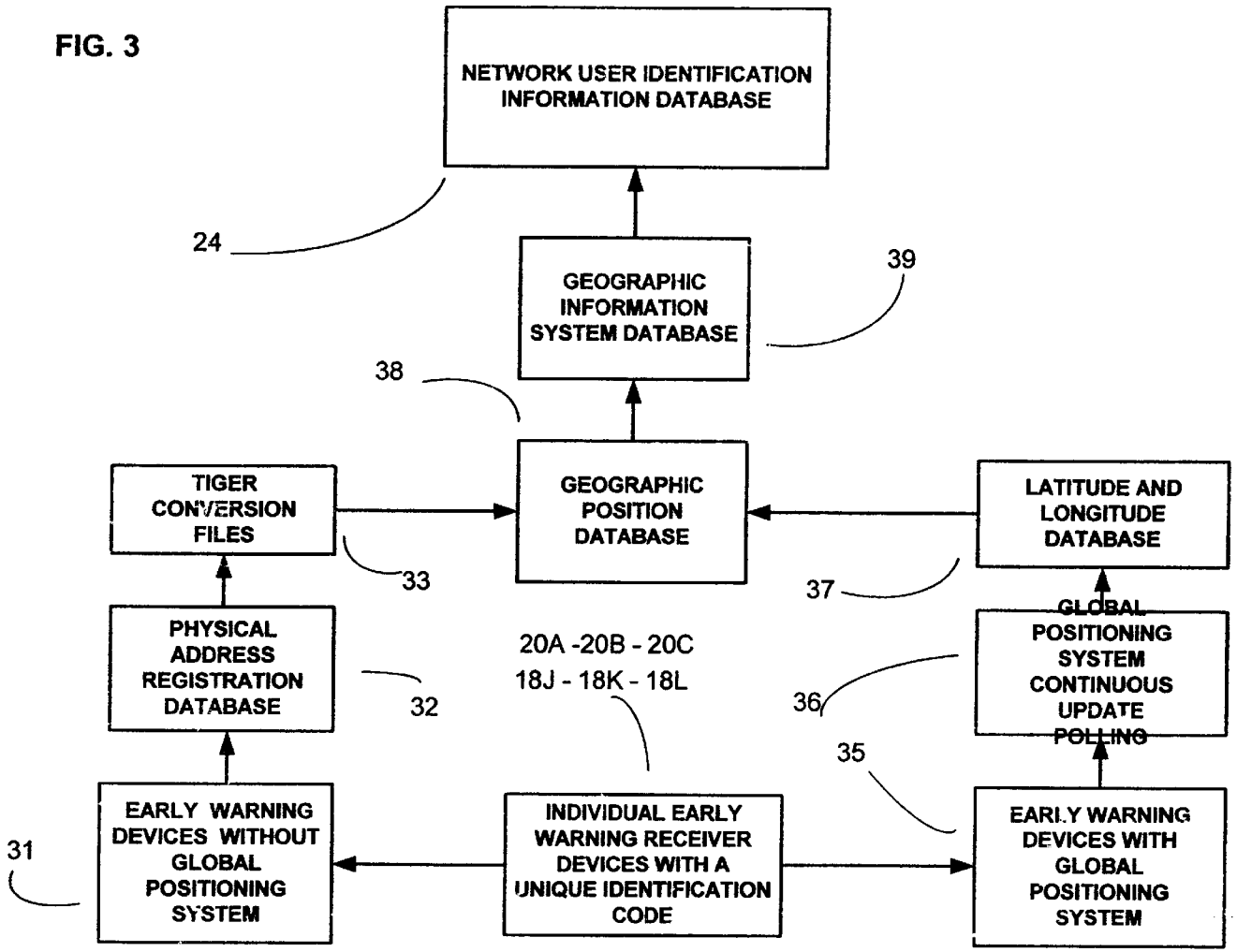
FIG. 3 is a block diagram illustrating the exemplary embodiments of a network user identification information database and multiple data sources according to the principles and preferred embodiments of the present invention.

FIG. 3 illustrates a block diagram of the main components of a network user identification database in accordance with the present invention. In this preferred embodiment a plethora of individual early warning receiver devices 18J, 18K, and 18L, and a plethora of individual emergency response early warning receiver devices 20A, 20B, and 20C each with a unique identification code are illustrated. All early warning devices with a unique identification but without GPS (Global Positioning System) capability 31 are shown receiving a physical address registration 32. The physical address of an early warning device is shown converted using TIGER (Topologically Integrated Geographic Encoding and Referencing) software conversion files 33 to give each early warning device a specific latitude and longitude coordinate. This embodiment also illustrates a unique identification early warning device 35 equipped with a GPS 36 means and frequent device update polling to create a continuously updated specific latitude and longitude coordinate file 37 for an early warning receiver device. This preferred embodiment illustrates a merged geographic position database 38 with the latitude and longitude position coordinates for early warning devices equipped with unique identification codes. This geographic position database is shown merged with a GIS (Geographic Information System) database 39, to create a complete network user identification information database 24 in accordance with the present invention.

Figure 4:
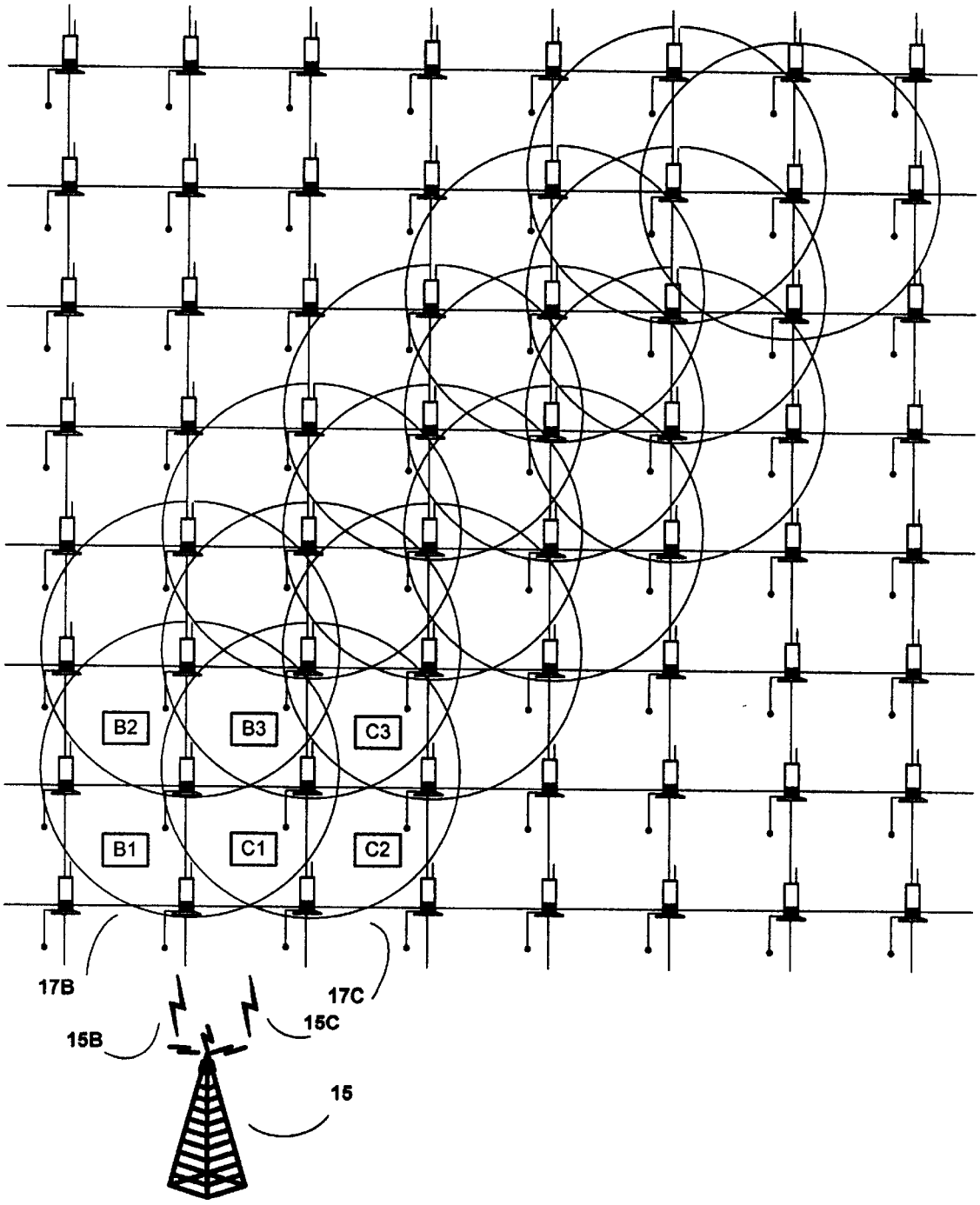
FIG. 4 is a system scale plan view of a warning area illustrating the exemplary embodiments of a cell area early warning signal transmission according to the principles and preferred embodiments of the present invention.

FIG. 4 illustrates a system scale view of cell warnings in a typical geographic area in accordance with the present invention. In this preferred embodiment is illustrated an area warning transmitter station transmitter 15 shown transmitting encoded early warning signals 15B and 15C. The encoded early warning signals are directed to a plethora of appropriate cell relay transmitters in the system as determined by the central processing site in accordance with this invention. The illustration shows two early warning signals 17B and 17C sent to all individual early warning receiver devices within the transmission area of the cell B relay transmitter and the cell C relay transmitter in accordance with the present invention.

Figure 5:
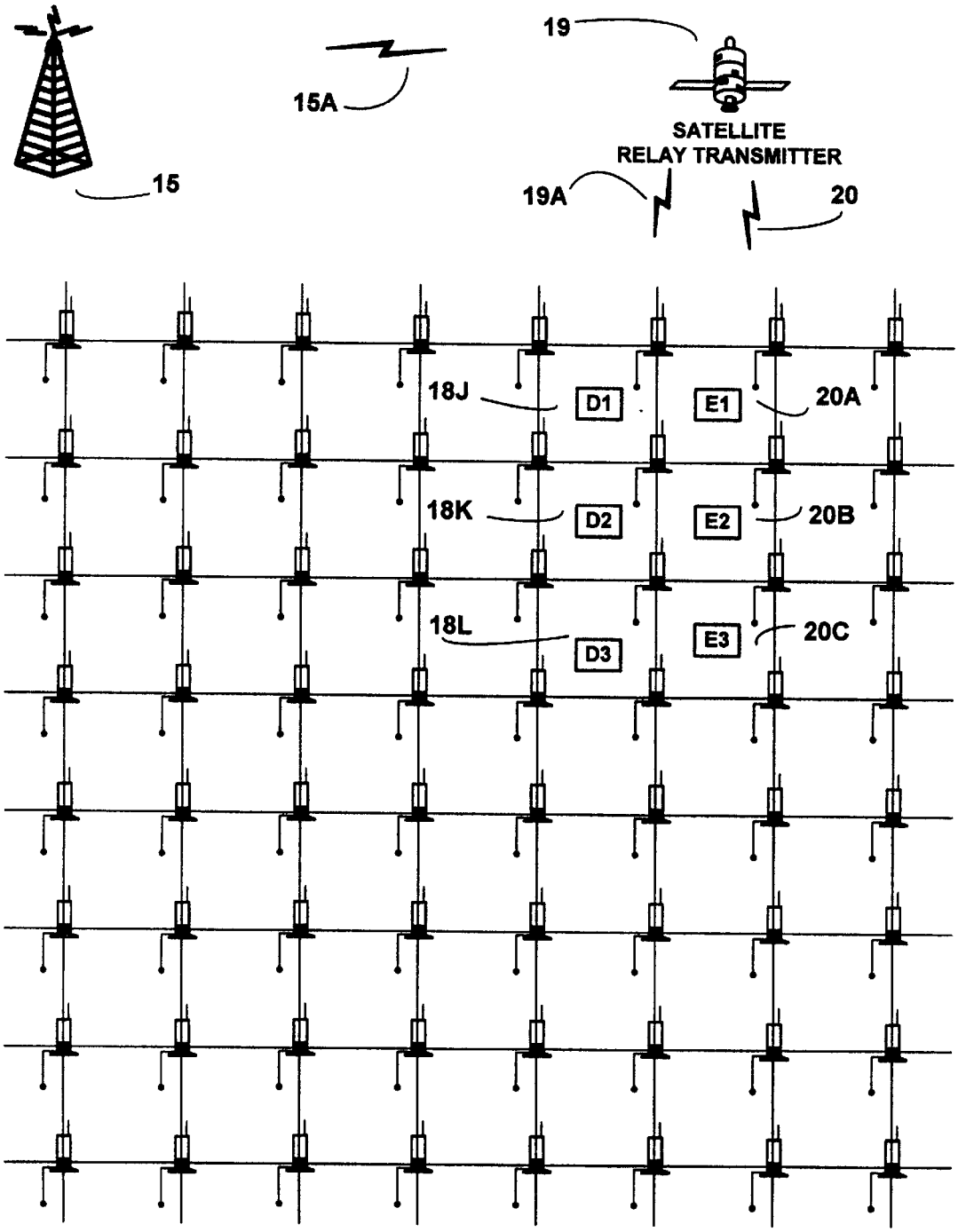
FIG. 5 is a system scale plan view of a warning area illustrating the exemplary embodiments of a selected user early warning signal transmission according to the principles and preferred embodiments of the present invention.

FIG. 5 illustrates a system scale view of selected user warnings in a typical geographic area in accordance with the present invention. Shown in this preferred embodiment are encoded warning signals 15A being sent by an area warning transmitter station transmitter 15. A satellite relay transmitter 19 is receiving these encoded warning signals and transmitting relayed encoded early warning signals 19A to selected individual receiver devices 18J, 18K, and 18L each equipped with a unique identification code. Also shown is an encoded early warning instruction signal 20 being relayed by a satellite relay transmitter 19 to selected individual emergency response early warning devices 20A, 20B, and 20C as determined by the central processing site in accordance with the present invention.

FIG. 6 provides a complete flow chart illustrating all aspects of the early warning system for all types of natural and manmade disasters in accordance with the present invention.

OPERATION OF THE INVENTION

Referring to FIG. 1 which is a block diagram illustrating an exemplary disaster warning system according to the present invention is seen a plethora of geographically distributed remote sensing, detection, and reporting sources 10A through 10N. It is the function of these sources to always be available to sense, detect, or collect reports of data indicative of the presence of any natural or manmade disaster event in real time as it is occurring. These sources are so located or placed in predetermined areas anywhere in the national or geographic area of a network that will most effectively collect real time information about these disasters as they are occurring. The data collected from these sources have both analog and digital input origins and will come from both fully automated and human derived sources. These collection sources will transmit continuous data about disaster events. The natural disasters that are to be reported by these sources include, but are not limited to, earthquakes, tornadoes, lightning storms, tsunamis, floods, fires, and other severe storms. The manmade disasters that are to be reported by these sources include, but are not limited to, chemical, biological, nuclear, or other technologically related accidents. The present invention teaches the placement and location of the remote sensors, detectors, and reporting sources, are disaster and technology dependent. For those disasters that are more time sensitive, for example earthquakes, the placement of "P" wave detectors will require geographically compact and widespread dispersion. For other disasters such as tornadoes or lightning storms, as an example, a single Doppler radar site can cover a large geographic area.

All collected real time information and data from all sources regarding these disasters is continuously transmitted 11 by high speed wireless radio frequency in the preferred embodiment from these sources to a central data receiving station 12. Those skilled in the art to which the present invention pertains will understand that other transmission means such as telephone or data lines can also be used. The method of transmission chosen for all data and signal transmissions in the present invention should stress reliability and data transfer rates during, and after, disasters.

A central data receiving station 12 receives the continuously transmitted data and information from all local, regional, and national sources both from the local geographic network sources as well as all other appropriate geographic networks when necessary as determined by the nature and extent of the disaster. By way of example, a disaster such as a tornado or a biological accidental release that is not limited to the area served by an initial reporting system would report data to other contiguous systems expected to be impacted by a disaster based on current prevailing wind and weather conditions.

Collected data from the entirety of sources is continuously transmitted 12B by a central data receiving station 12 to a central processing site for data analysis 13. The function of a central processing site for data analysis is to continuously analyze data sent from all sources and determine if early warnings for disasters are needed, the type of warning to be sent, which warning devices should receive the warnings, and which areas should be warned, based on data received from all sources. To complete this function, a high speed data transmitter 13A sends warning signal information to an area warning transmitter 14 located in the geographic area of a warning network. The preferred embodiment of the present invention would have back up reserve sites in different locations for a central data receiving station 12, a central processing site 13, and for an area warning transmitter station in the event main sites were damaged by a disaster. The preferred embodiment would place a central receiving station, a central processing site, and an area warning transmitter station in each large geographic region such as a standard metropolitan statistical area. Any or all of these sites could also be placed only at regional or national locations to reduce infrastructure costs.

The most effective early warnings are those provided with a maximum amount of warning time, are given through multiple types of warning devices, are given with a minimum of false alarms, are limited to only those geographic areas that are actually in danger, and which allow both human and automated responses to minimize the loss of lives, injuries, and property damages during disasters. Thus, there are two primary functions of an area warning transmitter that are controlled by a central processing site. The first function is to transmit encoded area warning alert signals 15B and 15C through an area warning transmitter 15 to cell relay transmitters 16B and 16C. These cell relay transmitters send early warning signals 17B and 17C to all individual early warning cell receiver devices 18D through 18I located within each cell area. With this function the present invention is able to select exactly which cells will be affected by a disaster impact and to send an early warning to all receiver devices located within the area of one or more cells. This allows early warnings to be sent to only those receivers located in defined and geographically compact areas that will experience the disaster effects. As taught in the present invention and shown in FIG. 1, a cell relay transmitter 16A that has not been selected by a central processing site 13 to receive an encoded early warning signal, has in turn, not sent early warning signals to any cell receiver devices 18A, 18B, and 18C in its area. Warning only those specific areas in actual danger from a disaster will serve to increase the confidence of those receiving warnings in the need to take a responsive action in order to mitigate disaster effects.

The second primary function of the area warning transmitter is to transmit encoded early warning signals 15A to orbiting satellite relay transmitters 19. The preferred embodiment would be for multiple satellite relay transmitters to be available to cover the widest possible geographic area. A satellite relay transmitter transmits a relayed encoded early warning signal 19A to one or many individual early warning cell receiver devices 18J, 18K, and 18L. The preferred embodiment would create a specific identification code for each of these types of receivers to enable the network to maintain exact position database files for each receiver device. This embodiment would transmit an encoded early warning signal that is received only by specific devices that were selected to receive an early warning signal, as determined by the central processing site, and then allow receipt of the actual early warning signal. One skilled in the art can appreciate that encoded warning signals will be received by all receivers, but will allow only selected receivers to receive an actual early warning signal. All receivers that are equipped to receive encoded early warning signals have a specific identification number that must be selected as part of the transmission signal. A central processing site in accordance with the invention determines the selection of which receivers are to receive actual early warning signals.

A preferred embodiment of the present invention allows a central processing site to direct an early warning signal to only one or many selected and specific receiver devices. Some of the many ramifications are that warning devices in geographically remote areas can receive early warning signals; areas with small populations can economically receive early warning signals; and a selected individual or small group of selected individuals in disparate geographic areas can receive early warning signals. Some specific examples would include the ability to warn only those early warning receivers located in a flood plain during a flash flood or broken dam, or to warn only those early warning receivers along a narrow strip of coast during an tsunami.

The present invention also teaches a satellite relay transmitter 19 transmitting a relayed encoded early warning instruction signal 20 to one or many individual emergency response early warning receiver devices 20A, 20B, and 20C. The preferred embodiment would create a specific identification code for each of these types of receivers to enable the network to maintain exact position and geographic information database files for each receiver device. This embodiment would transmit an encoded early warning instruction signal that is received only by specific devices that were selected to receive an early warning instruction signal, as determined by the central processing site, and allow receipt of the actual early warning instruction signal. This ramification will allow location and position knowledge of all emergency response personnel and resources so that the appropriate receivers are instructed in advance of a disaster impact and allow a much higher quality of directed emergency response during disaster impacts. The higher quality level of information received by the emergency response teams will result in better response efforts.

Additional embodiments include the ability to warn specific selected types of users such as utility and fueling stations at the time of an earthquake to allow control of specific natural gas mains, fuel lines, and electrical grid flows to affected areas. The preferred embodiment of the present invention teaches a wide range of popular consumer and commercial products being embedded with microprocessor receiver controllers to enable the devices to receive early warning signals and serve as an audible warning device in addition to its original function. These devices will include but are not limited to televisions, radios, cell phones, pagers, smoke alarms, computers, and burglar alarms. A wide range of commercial devices and equipment will be embedded to receive early warning signals and provide both audible as well as automated protective responses to mitigate the effects of a disaster. These devices will include but are not limited to control and activation of emergency lighting and public address systems, fuel and gas line controls, control of utility transmission networks, roadway transportation controls, and school and hospital facility controls. One skilled in the state of the art will see that the continuous upgrading of the early warning signals during the progress of a disaster along the ground will also create changes in the areas to be warned, the specific devices to receive warnings, the responses of the devices, and the informational content of the warning signals to further increase the value and effectiveness of the warnings.

FIG. 2 illustrates a detailed view of a central processing site 13. This view illustrates the preferred embodiment of the present invention showing the collected disaster data information received by a main processing system computer and controller 21. Continuously upgraded disaster information from all of the remote sources 10A though 10N is received by the main computer and controller which then connects with 22 a neural network parallel processor with event archives and modeling software 23. All of these functions operate in conjunction with the network user information database 24. The network user database has a main function of keeping a real time current database file for all individual early warning receiver devices with a unique identification code 18J, 18K, and 18L, as well as for all individual emergency response early warning receiver devices with a unique identification code 20A, 20B, and 20C. It is a function of a central processing site to automatically analyze all the data being received from all real time disaster data sources and compare the data with all real time event archive databases and with the real time network user information databases. The central processing site then determines the specific location, intensity, magnitude, speed of travel, and other necessary data regarding a disaster in real time. One skilled in the art comprehends the combined integration of neural net software, collected disaster event archive data, and modeling software, in a parallel processor. These techniques are applied and upgraded with continuously received upgraded data from disaster events. As taught by the present invention, the main processing system computer and controller is completely integrated with the neural network processor and software and with the network user information database.

This integration and analysis of real time disaster data from remote sources with preprogrammed decision analysis software and all the available databases herein noted, allows the system to determine if a warning should be sent, which receivers should be selected to receive the warning, and the type of warning to be sent. Encoded early warning signal information from the central processing site is transmitted 13A to a area warning transmitter station 14.

A major ramification of this complete integration of current real time data and information sources is that warnings received by early warning receivers have a very high level of information quality and content that is received by an unlimited number and variety of electronic devices to create an unlimited range of mitigation responses by early warning receivers. A further ramification allowed by this system when utilized by individual emergency response early warning receivers is the ability to determine, in advance of a disaster impact, exactly which emergency personnel are best suited for the fastest and most appropriate initial response to a wide range of disasters that will require immediate actions to more fully mitigate disaster damages. In many situations, fire, police, ambulance, haz/mat, and a wide variety of emergency response personnel can all be located, coordinated, and notified prior to an actual disaster impact to further reduce disaster impacts.

Those skilled in the art will understand the uses and functions of a central administrative office 27, a common power supply 26, and specific types of system security, housekeeping and mechanical monitors 25 that are located at the physical location of the central processing site. The central processing site will function for many different regions and geographic areas but it may be preferable that each geographic area have its own site that can serve as a back up location for other areas in the event of facility loss during a disaster. In the preferred embodiment the system receives real time information about disasters, as they are occurring to enable early warnings to be sent only to those specific areas or specific users in danger from an approaching disaster. Real time analysis and predetermined event decision matrices allows the system, automatically and without any human intervention, to determine that an early warning needed to be sent, the type of warning information signal to be sent, the areas that needed to receive warning information, which warning devices must receive the signals, and the method of signal transmission.

FIG. 3 illustrates a detailed view of a block diagram of a network user identification information database. The function of the database and its use of GPS and GIS information in real time is to maintain current and exact geographic location information for all early warning receiver devices equipped with a unique identification code 18J, 18K, and 18L, and for all emergency response early warning receivers equipped with a unique identification code 20A, 20B, and 20C. Early warning devices with a unique identification code without GPS capability 31 use a physical address registration database 32. A preferred embodiment of the procedure for maintaining this database would allow the owner of each user warning device to contact a central administrative office using toll free phones, fax, mail, or e-mail means whenever a device is purchased or moved to a different location. This contact notification would advise the identification number affixed to the device and the physical location address where the device is currently located. As an illustrative example, the device owner would call a central administrative office toll free phone when a warning device television was purchased or moved to a new location and provide the city, and street location of the device. One skilled in the art will see that the use of a physical street address and the application of TIGER data conversion files 33 will allow the exact physical location, utilizing latitude and longitude coordinates to be known. TIGER is the trademark name for a database known as Topologically Integrated Geographic Encoding and Referencing files. Information from this database is then placed in a geographic position database 38.

Early warning devices with an identification code but without GPS ability would typically be devices that are designed to be stationary devices and not frequently moved from location to location. Those skilled in the art will comprehend that GPS is a commonly used acronym for Global Positioning System, and will further understand that it can pertain to a wide variety and combination of satellites, transmission towers, and communication techniques, all devoted to methods to determine a specific latitude and longitude coordinate to determine a geographic position on the surface of the earth. For warning devices that are typically designed to be mobile and frequently change locations, the preferred embodiment would include early warning devices with a unique identification code as well as a GPS position locating function 35. These devices as taught in the present invention are equipped with a GPS function and frequent GPS location polling 36 to allow mobile receivers to be continuously tracked. One skilled in the art will see that GPS technology will provide very specific longitude and latitude coordinates for any warning device so equipped and will create a current latitude and longitude database 37. The known latitude and longitude coordinates for early warning devices with and without GPS ability are merged into a combined geographic position database 38. This geographic position database is then merged with current geographic information database 39.

One skilled in the art will see that Geographic Information System databases when merged with the GPS location coordinates will provide a completely integrated network user identification information database 24. Each receiver warning device equipped with a unique identification code will be known in the database with its exact latitude and longitude position as well as any other data that can be extracted from various geographic information databases to be useful in an early warning network with a function of mitigating the effects of disasters on lives and property. The function of this integrated database as used by the central processing site is to allow the transmission of continuously upgraded early warning signals to any specific device or group of devices that are equipped as illustrated in accordance with the present invention.

There are many important ramifications of the ability to always know exact geographic position as well as a wide variety of other current geographic information regarding each early warning receiver. Those skilled in the art will understand that warnings can be tailored to meet the requirements of every warning device dependant on the type, magnitude, and speed of a disaster. High quality informational instruction warnings can be sent to the most appropriate emergency response personnel in advance of a disaster impact when real time position and geographic information is known.

In FIG. 4 is illustrated a system scale view of cell alert warning signals. For early warnings transmitted to all warning devices in specific geographic areas, a central processing site 13 instructs an appropriate area warning transmitter 15 to transmit encoded alert warning signals 15B and 15C to one or more cell relay transmitters. As shown in this illustration, cell B relay transmitter 16B and cell C relay transmitter 16C along with a plethora of other cells, have received encoded early warning signals. As instructed in this illustration, early warning signals 17B and 17C are transmitted to all receiver devices located in the transmission range of cell B and cell C. As shown in the illustration, any combination of selected cell transmitters can be instructed to transmit early warning signals to enable any appropriate sized geographic area as determined by the central processing site to receive disaster early warnings.

The present invention teaches the information regarding location and size of all cells is always current and resident in the central processing site 13 to allow an exact determination of which geographic areas will be warned based on specific real time characteristics of a disaster occurrence. The geographic cell sizes and placement is based upon the specific disaster needs of a given community. However, a preferred embodiment would create geographically compact cell sizes roughly the size of existing PCS wireless phone cells and are primarily based on geographic size and population densities. The invention teaches a cell size to promote a highly effective level of early warning accuracy, timeliness, and area specificity during the occurrence of natural and manmade disasters.

In FIG. 5 is illustrated a system scale view of selected user warning signals being issued. For early warnings transmitted to individual early warning receiver devices with a unique identification code, the central processing site instructs an appropriate area warning transmitter 15 to transmit an encoded alert warning signal 15A to an orbiting satellite relay transmitter 19. The encoded early warning signal is then transmitted 19A to one or more selected receiver devices with unique identification codes. As shown in this illustration selected receiver devices 18J, 18K, and 18L have received encoded early warning signals regarding a disaster. Also shown in this illustration an encoded early warning instruction signal is transmitted 20 to one or more selected emergency response early warning receiver devices with unique identification codes 20A, 20B, and 20C. As taught by the present invention, any combination of selected receiver devices with unique identification codes can be selected by the central processing site to receive disaster warnings. This further allows highly selective early warning signals to be sent to any combination of early warning devices and result in much improved mitigation responses to all types of disasters.

An alternative embodiment of the present invention allows the localized cell relay transmitters to issue encoded early warning signals to specific devices. Further, the system can be programmed to allow devices with unique identification codes to receive encoded warning signals from a satellite relay transmitter, a cell warning transmitter, or cell area warning signals directed to all receivers in a cell. The functional ramifications of this ability to select which receivers are warned can be seen by those skilled in the art of GPS and GIS systems. Warnings can be directed to specific users based on a wide variety of data inputs available from these GPS and GIS databases. Each device will maintain a known real time exact location, a known altitude, a known local terrain, a known local population density, and many other factors that can be seen by those skilled in the art. When these real time known data factors are compared to current real time local conditions such as, but not limited to, wind patterns, time of day, recent rainfall amounts, and received real time disaster data, the ability to provide highly informative and effective early warnings for disaster events becomes much enhanced.

FIG. 6 illustrates an early warning system flowchart illustrating the preferred embodiment of the present invention. The functional result of the system is to transmit continuously upgraded early warning signals that will be received by only those warning devices that are selected by the central processing site as being in imminent danger from the damaging effects of a natural or manmade disaster. In the preferred embodiment of the present invention, the early warning signals will be received by embedded microprocessor receivers that will initiate a wide variety of early warning mitigation responses as predetermined by the encoded software in each device. All of these responses will serve to lessen the effects of natural and manmade disasters on lives and property.

Those having skill in the art to which the present invention pertains will now understand that there are many applications and ramifications for the present invention. The present invention has been described in sufficient detail to enable one skilled in the art to make and use the invention. Accordingly specific details which are readily available in the art or otherwise conventional, such as the frequency of radio transmissions and the like have been omitted to prevent misunderstanding of the essential features of the invention. As examples, "P" waves, GPS, GIS, TIGER, neural network, analog sensors, emergency response systems, and others, although not specifically described, may be any one of a large number of conventional designs described in the literature and in common use in science and research.

CONCLUSION AND SCOPE OF INVENTION

Thus it will be seen that the early warning system for natural and manmade disasters described herein will result in the most highly effective system available to mitigate and lessen the impacts of natural and manmade disasters on lives and property wherever it is utilized. The system will provide a maximum amount of advance early warning for all known types of natural and manmade disasters. The system will determine exactly which areas and which warning receiver devices are in danger from an approaching disaster. The system will identify specific early warning receiver devices and will know the current real time position and geographic information for each receiver. The system will identify specific emergency response early warning devices and will know the current real time position and geographic information for each receiver.

The system will transmit early warnings to a very wide variety of commonly used commercial and consumer devices that will initiate a wide range of both human and automated responses to lessen the impact of a natural or manmade disaster on people and property. The system will transmit early warning instructions to a wide variety of devices used by emergency response personnel who are selected as the most appropriate first responders to lessen the impact of a natural or manmade disaster on people and property.

It will be seen that all receipt, processing, and transmission, of disaster information is conducted in real time and uses automated methods and high speed data transmissions. The warning information is received by a wide variety of commonly used devices and early warnings are sent only to those specific areas and specific devices that are determined to be in actual danger from a disaster. The system also identifies and selects the most appropriate emergency response personnel in real time to initiate early warning instructions and provide a great increase in the quality of the response to further lessen the impact of a natural or manmade disaster on people and property. Finally, the speed of the warnings, the ubiquity of the warning devices and warning responses, and the receiver specificity of the warnings, all allow system users to obtain the highest possible mitigation value from early warnings of natural and manmade disasters.

Although this description contains exemplary details, these should not be construed as limiting the scope of the invention but as merely providing illustrations of some of the presently preferred embodiments thereof. Many variations are possible. In view of the foregoing it will be understood that the present invention may be implemented in a variety of alternative ways using a variety of alternative processing methods, but that all such implementations and processing methods are deemed to be within the scope of the present invention which is to be limited only by the claims appended hereto. Thus, the scope of the invention should be determined only by the appended claims and their equivalents.

I claim:

1. An early warning system for natural and manmade disasters comprising:

a plurality of early warning receiver devices distributed over a wide area within a general population, and each having a receiver means for receiving early warning signals indicative of natural and manmade disasters;

a plurality of remote sensing, detection, and reporting sources, distributed over a wide area, and each having:
- a means for acquiring data indicative of natural and manmade disasters, and
- a transmitter means for transmitting said disaster data;

a central processing site for data analysis having:
- a receiver for receiving the disaster data signals from said plurality of remote disaster data sources,
- a geographic position database, and a means for continuous updating, containing a current geographic position for each said early warning receiver device,
- a geographic information database, and a means for continuous updating, containing a plethora of current geographic information data based on said geographic position for each said early warning receiver device,
- a computer having analysis means to determine if an early warning should be transmitted based on all said received data,
- a computer having analysis means to determine which specific early warning receivers and geographic areas are to receive warnings based on analysis of all said data, and
- a transmitter having means for transmitting early warning signals to:
  - any selected early warning receiver,
  - any group of selected early warning receivers, and
  - to all early warning receivers located in specific geographic areas, in imminent danger from a natural or manmade disaster based on said computer analysis of said disaster data, said geographic position database, and said geographic information database;

whereby only early warning receivers that are in actual danger from an imminent natural or manmade disaster will receive early warning signals to cause a preprogrammed mitigation response to reduce disaster effects to lives and property.

2. The early warning system for natural and manmade disasters recited in claim 1 further comprising a plurality of early warning receivers dispersed among an entire general population and each having a unique identification code and further having a global positioning system means to continuously update a geographic position for each device; whereby said geographic position will be useful for a warning decision analysis determination by said early warning system during a natural or manmade disaster occurrence.

3. The early warning system for natural and manmade disasters recited in claim 1 further comprising a plurality of early warning receivers dispersed among an entire general population and each having a unique identification code and further having a triangulation positioning system using signal attenuation means to continuously update a geographic position for each device; whereby said geographic position will be useful for a warning decision analysis determination by said early warning system during a natural or manmade disaster occurrence.

4. The early warning system for natural and manmade disasters recited in claim 1 further comprising a geographic information database having a means to continuously update geographic information for each said early warning device based on said geographic position indicative of current altitude, terrain type, weather condition, and population density; whereby said geographic information will be useful for a warning decision analysis determination by said early warning system during a natural or manmade disaster occurrence.

5. The early warning system for natural and manmade disasters recited in claim 1 further comprising an array of cell relay transmitters distributed over a wide area and having means to receive said encoded early warning signals transmitted by said central processing site area warning transmitter; and wherein each said cell relay transmitter comprises a means for transmitting said encoded early warning signals to selected early warning receivers; whereby one or more selected early warning receivers will receive early warnings during a natural or manmade disaster occurrence.

6. The early warning system for natural and manmade disasters recited in claim 1 further comprising an array of cell relay transmitters distributed over a wide area and having means to receive said encoded early warning signals transmitted by said central processing site area warning transmitter; and wherein each said cell relay transmitter comprises a means for transmitting said early warning signals to all early warning receivers in the transmission range of the cell transmitter; whereby all early warning receivers in the transmission range of the cell transmitter will receive early warnings during a natural or manmade disaster occurrence.

7. The early warning system for natural and manmade disasters recited in claim 1 further comprising an orbiting satellite relay transmitter having means to receive said encoded early warning signals transmitted by said central processing site area warning transmitter; and wherein each said orbiting satellite relay transmitter comprises a means for transmitting said encoded early warning signals to selected early warning receivers; whereby one or more selected early warning receivers will receive early warnings during a natural or manmade disaster occurrence even if they are in remote areas or areas without cell transmitter abilities.

8. The early warning system for natural and manmade disasters recited in claim 1 further comprising a plurality of early warning receivers dispersed among an entire general population wherein said early warning devices comprise an embedded microprocessor controller having means for receiving said early warning signals and generating a preprogrammed mitigation response: whereby said electrical devices will initiate a response to reduce impacts to lives or property during a natural or manmade disaster occurrence.

9. The early warning system for natural and manmade disasters recited in claim 8 further comprising a plurality of early warning receivers dispersed among an entire general population wherein said early warning devices comprise an embedded microprocessor controller having means for activating and deactivating selected electrical devices: whereby said electrical devices that have been left in an off position, are activated and turned on to allow receipt of said early warning signals during a natural or manmade disaster occurrence.

10. An early warning system for natural and manmade disasters comprising:

a plurality of emergency response early warning receiver devices with a unique identification code distributed over a wide area to emergency response personnel and offices, and each having a receiver means for receiving emergency response early warning instruction signals indicative of natural and manmade disasters;

a plurality of remote sensing, detection, and reporting sources, distributed over a wide area, and each having:

a means for acquiring data indicative of natural and manmade disasters, and a transmitter means for transmitting said disaster data;

a central processing site for data analysis having:

a receiver for receiving the disaster data signals from said plurality of remote disaster data sources, a geographic position database, and a means for continuous updating, containing a current geographic position for each said emergency response early warning receiver device, a geographic information database, and a means for continuous updating, containing a plethora of current geographic information data based on said geographic position for each said emergency response early warning receiver device, a computer having analysis means to determine if an early warning instruction signal should be transmitted based on all said received data, a computer having analysis means to determine which specific emergency response early warning receivers are to receive warnings based on analysis of all said data, and a transmitter having means for transmitting emergency response early warning instruction signals to:

any selected emergency response early warning receiver, any group of selected emergency response early warning receivers, and to all emergency response early warning receivers located in specific geographic areas, in imminent danger from a natural or manmade disaster or whose emergency response services may be needed in another area based on said computer analysis of said disaster data, said geographic position database, and said geographic information database;

whereby the most appropriate emergency response early warning receivers as determined by the system will receive early warning response instructions during an imminent natural or manmade disaster, and allow a more effective mitigation response to reduce disaster effects to lives and property in that or other surrounding areas.

11. The early warning system for natural and manmade disasters recited in claim 10 further comprising a plurality of emergency response early warning receivers dispersed among emergency response personnel and offices each having a unique identification code and further having a global positioning system means to continuously update a geographic position for each receiver device; whereby said geographic position will be useful for a warning decision analysis determination by said early warning system during a natural or manmade disaster occurrence.

12. The early warning system for natural and manmade disasters recited in claim 10 further comprising a plurality of emergency response early warning receivers dispersed among emergency response personnel and offices each having a unique identification code and further having a triangulation positioning system using signal attenuation means to continuously update a geographic position for each device; whereby said geographic position will be useful for a warning decision analysis determination by said early warning system during a natural or manmade disaster occurrence.

13. The early warning system for natural and manmade disasters recited in claim 10 further comprising a geographic information database having a means to continuously update geographic information for each said emergency response early warning device based on said geographic position indicative of current altitude, terrain type, weather condition, and population density; whereby said geographic information will be useful for a warning decision analysis determination by said early warning system during a natural or manmade disaster occurrence.

14. The early warning system for natural and manmade disasters recited in claim 10 further comprising an array of cell relay transmitters distributed over a wide area and having means to receive said encoded emergency response early warning signals transmitted by said central processing site area warning transmitter; and wherein each said cell relay transmitter comprises a means for transmitting said encoded emergency response early warning signals to selected emergency response early warning receivers; whereby one or more selected emergency response early warning receivers will receive emergency response early warnings during a natural or manmade disaster occurrence.

15. The early warning system for natural and manmade disasters recited in claim 10 further comprising an orbiting satellite relay transmitter having means to receive said encoded emergency response early warning signals transmitted by said central processing site area warning transmitter; and wherein each said orbiting satellite relay transmitter comprises a means for transmitting said encoded emergency response early warning signals to selected emergency response early warning receivers; whereby one or more selected emergency response early warning receivers will receive emergency response early warnings during a natural or manmade disaster occurrence even if they are in remote areas or areas without cell transmitter abilities.

16. The early warning system for natural and manmade disasters recited in claim 10 further comprising a plurality of emergency response early warning receivers dispersed among emergency response personnel and offices wherein said emergency response early warning devices comprise an embedded microprocessor controller having means for receiving said emergency response early warning instruction signals and generating a mitigation instruction response: whereby said emergency response receiver devices will initiate an emergency response to reduce impacts to lives or property during a natural or manmade disaster occurrence.

* * * * *